US006416406B1

(12) United States Patent
Duhamel

(10) Patent No.: US 6,416,406 B1
(45) Date of Patent: Jul. 9, 2002

(54) METHOD FOR PLAYING AN AUXILIARY GAME WITH PRIZE REWARDING SYSTEM

(75) Inventor: Gérald Duhamel, Drummondville (CA)

(73) Assignee: Labtronix Concept, Drummondville (CA)

( * ) Notice: Subject to any disclaimer, the term of this patent is extended or adjusted under 35 U.S.C. 154(b) by 0 days.

(21) Appl. No.: 09/496,280

(22) Filed: Feb. 1, 2000

(51) Int. Cl.[7] ..... A63F 1/00
(52) U.S. Cl. ..... 463/12; 273/274
(58) Field of Search ..... 273/274, 138.1, 273/292; 463/11, 17, 14, 13, 12

(56) References Cited

U.S. PATENT DOCUMENTS

| | | | | |
|---|---|---|---|---|
| 4,570,934 | A | * | 2/1986 | Smyth |
| 4,669,731 | A | * | 6/1987 | Clarke |
| 5,393,057 | A | * | 2/1995 | Marnell |
| 5,494,296 | A | | 2/1996 | Grassa |
| 5,570,885 | A | | 11/1996 | Ornstein |
| 5,586,766 | A | | 12/1996 | Forte et al. |
| 5,630,753 | A | | 5/1997 | Fuchs |
| 5,639,088 | A | * | 6/1997 | Schneider |
| 5,664,999 | A | | 9/1997 | Kurihara |
| 5,695,402 | A | * | 12/1997 | Stupak |
| 5,743,800 | A | | 4/1998 | Huard et al. |
| 5,823,874 | A | | 10/1998 | Adams |
| 5,848,932 | A | * | 12/1998 | Adams |
| 5,980,384 | A | * | 11/1999 | Barrie |
| 6,059,289 | A | * | 5/2000 | Vancura |
| 6,089,976 | A | * | 7/2000 | Schneider |
| 6,089,978 | A | * | 7/2000 | Adams |
| 6,126,542 | A | * | 10/2000 | Fier |
| 6,142,873 | A | * | 11/2000 | Weiss |
| 6,159,097 | A | * | 12/2000 | Gura |

FOREIGN PATENT DOCUMENTS

| | | | |
|---|---|---|---|
| DE | 198 12 491 | A1 | 7/1999 |
| EP | 0 797 175 | A1 | 9/1997 |
| EP | 0 971 326 | A2 | 1/2000 |
| GB | 2 170 938 | A | 8/1986 |
| GB | 2 270 005 | A | 3/1994 |

* cited by examiner

*Primary Examiner*—Benjamin H. Layno
*Assistant Examiner*—Vishu K. Mendiratta
(74) *Attorney, Agent, or Firm*—Ogilvy Renault

(57) ABSTRACT

A method for playing an auxiliary game depending on the results or events of a primary game is provided. The events of the primary game are divided in three classes: credit event, no-credit event and non-event hold, and those events have different influences on the auxiliary game. The method for playing the auxiliary game comprises keeping information coming from the primary game and awarding the player of the primary game when a certain criteria is achieved on the auxiliary game. The method also comprises a visual display of the information recorded by the auxiliary game to improve the pleasure and to maintain the interest of the player who plays the primary game. The preferred embodiment of the method is an electronic gaming apparatus in which Blackjack is the primary game. A loss is defined as a no-credit event in the auxiliary game, a win with 21 is a credit event and other games are non-event holds. The visual display could be a matrix display wherein credit and no-credit events would be shown sequentially.

37 Claims, 9 Drawing Sheets

METHOD FOR PLAYING AN AUXILIARY GAME WITH PRIZE REWARDING SYSTEM

FIELD OF THE INVENTION

The present invention relates to an apparatus and a method for playing an auxiliary game along with a primary game, such as those played on casino tables or electronic gaming devices.

BACKGROUND OF THE INVENTION

In recent years, numerous auxiliary games have been developed and added to primary games. The goals of these auxiliary games are 1) maintain the interest of the player on the game and 2) create a need for the player to keep playing the game so that the apparatus used generates more revenues for its owner.

One strategy used to maintain the interest of the player is a jackpot or a progressive jackpot with a possible award much more interesting than the one the player can win on the primary game. Therefore, when players play a game, their interest is increased by the possibility of winning this jackpot. However, the players do not feel that they own the game or the apparatus. The players see that the jackpot will also be available if they use another apparatus or play another game.

Another strategy used for electronic gaming apparatus is the addition of a secondary game that players can access when particular events occur during the primary game. These secondary games let the players increase the amount won on the primary game or let the player have a chance to win a special award that can only be won in this secondary game. The excitement created does not last for a number of consecutive games because the player does not know when the event will occur. The jackpot or the access to the secondary game is usually awarded one game at a time. Nothing suggests that the next game could let the player win the jackpot more than the one he/she played before. These games do not give prolonged thrills, only a fixed number of short thrills.

A third strategy used to maintain the interest of the player is the one described in U.S. Pat. No. 5,393,057. In this example, a bingo matrix display (the secondary game) is coupled to a poker game (the primary game). The occurrence of different events in the poker game can produce a modification of the bingo matrix display. According to the rules of standard bingo, the player can win a prize in the auxiliary game. This game requires winning with certain hands at the game of poker to complete the bingo matrix display of the auxiliary game and to win the prize associated with the auxiliary game. The players do not feel that all games are important, they only feel that they could skip over the winning one if they quit the game for a few moments.

Another strategy available is a progressive jackpot used with live casino tables or a network of electronic gaming apparatus. This game has the disadvantages of the above-mentioned strategies.

Another strategy used is to gather a number of events of the primary game and, when a predetermined number of these events is gathered, players access an auxiliary game which usually is a prize multiplier. Most of the time, the calculation of these events is not displayed to players so they do not know when they will access the auxiliary game. Often, they are not aware of what controls the access to the auxiliary game.

Still another strategy is to give access to an auxiliary game wherein players gather points or the like and are rewarded according to the number of points gathered. The points are attributed and accumulated in the auxiliary game and are not a function of the primary game. The only relationship between the auxiliary game and the primary game is that events in the primary game control the access to the auxiliary game.

There have been no successful strategies to maintain the interest of players throughout their participation in primary games and to give them a feeling that each game played is important, without exception.

SUMMARY OF THE INVENTION

Accordingly, it is an object of the present invention to provide a method of playing an auxiliary game which maintains the interest of players and improves their pleasure of playing the game. A second object of the invention is to make each game played in the primary game an important one. A third object of the invention is to make players think they own the game so that they will continue to play and generate profits for the owner of the apparatus.

It is also an object of the present invention to provide a progressive payoff to maintain the interest of the player. Another object is to display information regarding credits obtained in a predetermined number of events to sustain the thrill. A further object of the invention is to maintain their thrill by letting players gather the number of credits needed to win prizes in a greater number of games than the number of outcomes influencing results in the auxiliary game. A player's chances of winning an auxiliary game prize are therefore increased.

According to the objects of the invention, a method of awarding a prize in an auxiliary game played along with a principal game is provided. The method comprises the steps of establishing a first class of outcomes in the principal game associated with a no-credit event in the auxiliary game, establishing a second class of outcomes associated with a non-event hold in the auxiliary game, establishing a third class of outcomes associated with a credit event in the auxiliary game, monitoring credits in the auxiliary game over a predetermined number of events and awarding a prize when a predetermined number of credits are present in this predetermined number of events in the auxiliary game, whereby avoiding no-credit events within a series of non-event holds and credit events increases a player's chances of winning an auxiliary game prize.

A preferred embodiment of this invention comprises an electronic gaming apparatus in which a primary game is linked to an auxiliary game that works according to the method defined above. A display of the information monitored by the auxiliary game should be placed above the display of the primary game and should be easy to understand by an untrained player. In the preferred embodiment, the primary game comprises a Blackjack game wherein a win with a card sum of 21 produces a credit event in the auxiliary game, a loss produces a no-credit event and a win with a card sum of 20 or below produces a non-event hold in the auxiliary game. A gaming matrix display showing a trace of credit and no-credit events is displayed above the primary game. A number of progressive prizes associated with the gaming matrix display can be awarded following criteria based on the number of credit events monitored and displayed in the gaming matrix display.

A second embodiment is provided in which the auxiliary game is played in association with another primary game, such as Poker. In this embodiment, the definition of the three classes of outcomes are preferably different from the definition used with Blackjack and follow the rules of Poker. Also, the prizes associated with the auxiliary game are preferably different along with the criteria used to award these prizes.

A further embodiment of the present invention uses the same method of playing an auxiliary game and is integrated in live casino table games such as Blackjack or Poker.

BRIEF DESCRIPTION OF THE DRAWINGS

These and other features, aspects and advantages of the present invention will become better understood with regard to the following description and accompanying drawings, wherein:

FIG. 9 is a schematic representation of an alternative to the playing screen of FIG. 2;

DETAILED DESCRIPTION OF THE PREFERRED EMBODIMENTS

Figure 1:
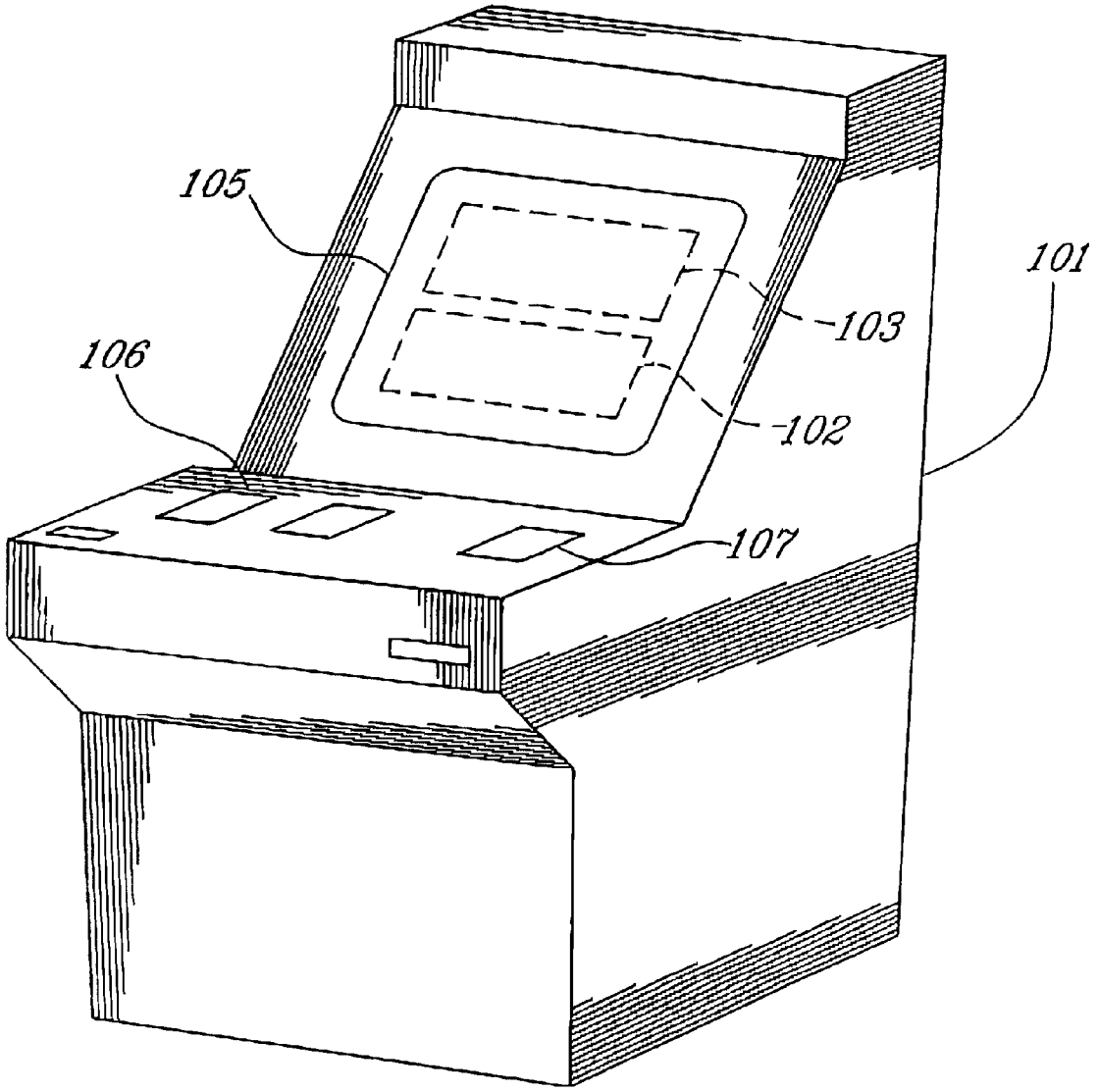
FIG. 1 is a front elevational view of a schematic representation of an electronic gaming apparatus built in accordance with the present invention.

As can be seen in FIG. 1, the electronic gaming apparatus 101 built in accordance with the present invention, includes a primary game, such as an electronic Blackjack game 102 that is electronically coupled to the auxiliary game 103.

In the preferred embodiment of the present invention, the primary game is an electronic Blackjack game 102, but other electronic games can be used. The electronic gaming apparatus 101 includes a playing screen 105. Some buttons 106 enable the player to input information in order to play the primary game. An auxiliary button 107 is available to input a command directly to the auxiliary game 103.

Figure 2:
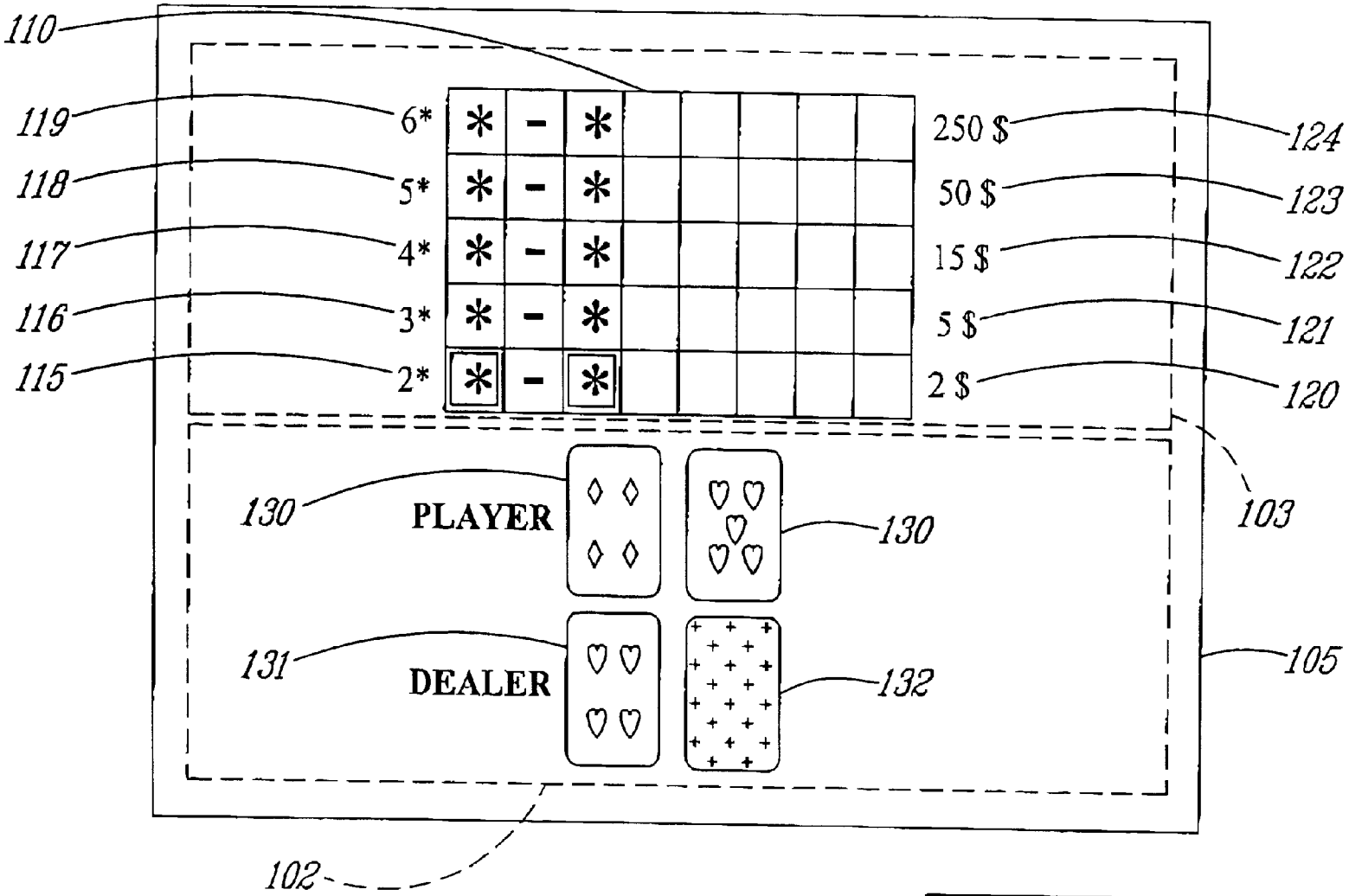
FIG. 2 is a schematic representation of the playing screen of the electronic gaming apparatus of FIG. 1.

Referring now to FIG. 2, when a player begins playing on the electronic gaming apparatus 101, the gaming matrix display 110 of the auxiliary game 103 should be empty. If it is not empty, the player can choose to press on the auxiliary button 107 which erases all the entries in the gaming matrix display 110. The player puts some coins or credits in the electronic gaming apparatus 101 to play a normal primary game such as Blackjack or Poker.

The information display outputs 115 through 124 let the player know what prizes can be won in the auxiliary game 103.

EXAMPLE 1

The present invention will be more readily understood with particular reference to the following example which is given to illustrate the invention rather than to limit its scope.

A hypothetical game would be played as follows: the player puts enough money in the electronic gaming apparatus 101 to play a full primary game and an auxiliary game 103. For the purpose of demonstration, the player chooses to empty the gaming matrix display 110 by activating the auxiliary button 107. The primary game played is Blackjack.

As in usual electronic Blackjack games, the player places a wager. Then, on the playing screen 105, a virtual dealer gives cards 130, 131 and 132 to the player and the dealer: two cards facing up 130 for the player and one card face up 131 and one face down 132 for the dealer. The player chooses to hold his/her cards or take new cards to complete his/her hand 130. If the player has a card sum higher than 21, the player automatically looses. If the player holds, the dealer turns his second card 132 face up and chooses to hold or add new cards. If the dealer has a card sum greater than 21, then the player automatically wins. The player wins if the sum of his/her cards 130 is closer to 21 than the dealer's sum.

Figure 3:
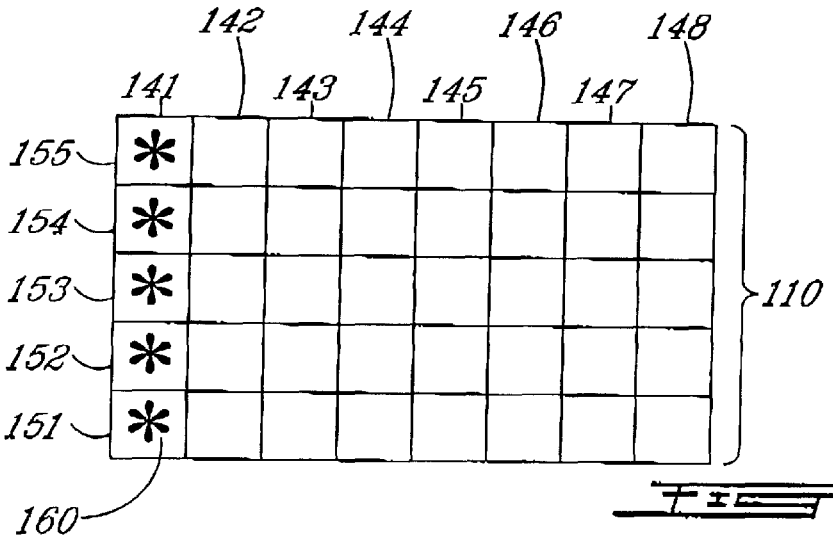
FIG. 3 is a schematic representation of the matrix display of the auxiliary game of FIG. 2.
Figure 4:
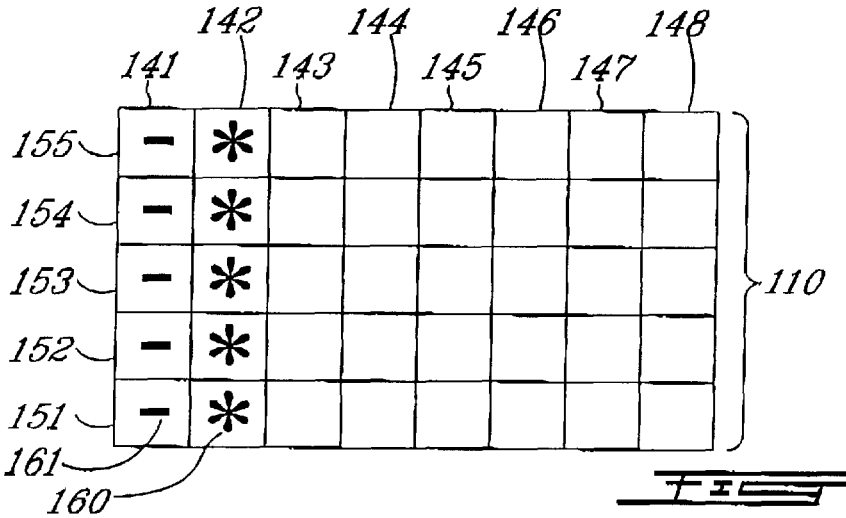
FIG. 4 is a schematic representation of the matrix display of the auxiliary game of FIG. 3, steps further in the game.

For clarity purposes, we will assume the following results for the electronic Blackjack game 102. In the first game, the player has a card sum of 21 and the dealer's cards 131 and 132 add up to 17. This is one type of event in the electronic Blackjack game 102 that produces an output in the gaming matrix display 110. The result is determined to be a credit event. The first column 141 of the display of the auxiliary game 103 is filled in with winning symbols 160, as shown in FIG. 3. The player then wins multiple hands without a card sum of 21. Because it is not the kind of result producing an output in the auxiliary game 103 (non-event holds), nothing changes on the gaming matrix display 110. Then, the player loses a game, this result is determined to be a no-credit event. The winning symbols 160 of the first column 141 are transferred onto the second column 142 and all the spaces on the first column 141 are filled with losing symbols 161 as seen on FIG. 4. A new winning game occurs, as shown in FIG. 5, with a player's card sum of 21, the symbols 160 and 161 on the columns 141 and 142 are respectively transferred on the columns 142 and 143 and column 141 is filled with new winning symbols 160.

Figure 5:
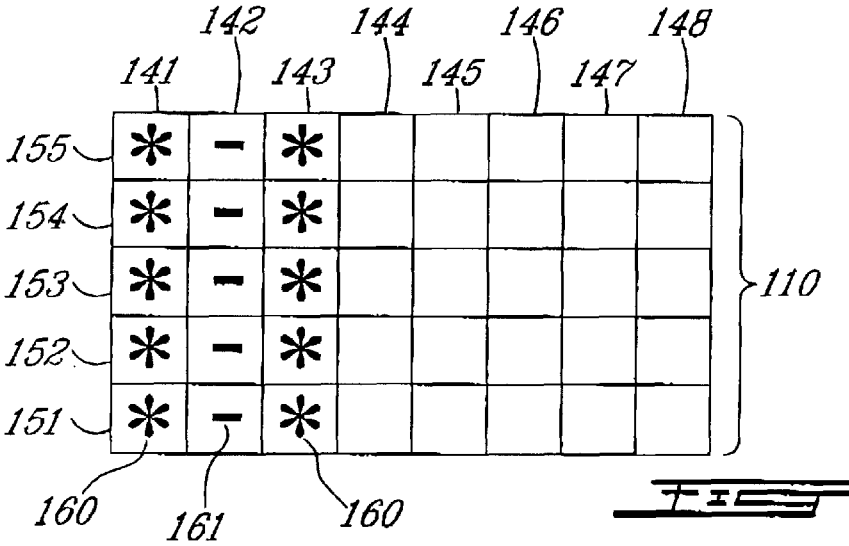
FIG. 5 is a schematic representation of the matrix display of the auxiliary game of FIG. 4, steps further in the game.

As can be seen on FIG. 5 there are two winning symbols 160 in the first line 151 of the gaming matrix display 110. From the information display outputs 115 and 120 of FIG. 2, the player wins a prize of 2$. The amount is paid to the player and the winning symbols 160 of the bottom line 151 are replaced by payment symbols 162 as shown on FIG. 6.

For the purposes of this example, the symbols have been chosen to be "*", "-" and "⊠." It will be understood that any symbol could be used to illustrate the possibilities.

Figure 7:
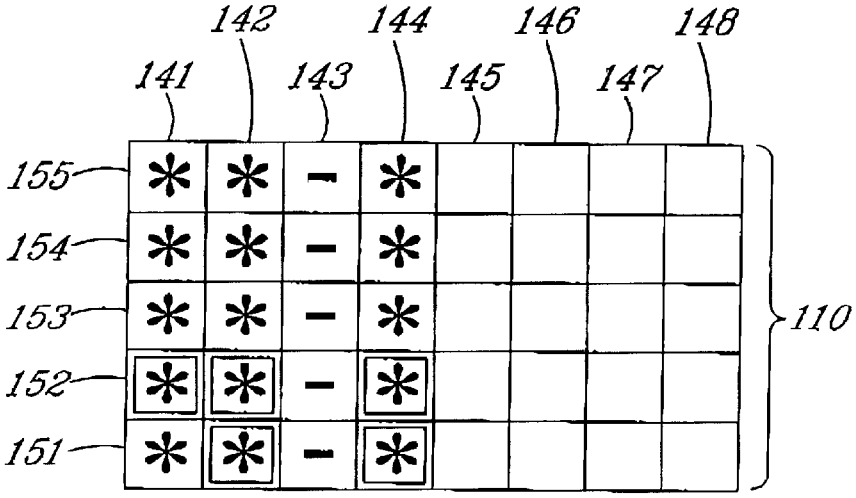
FIG. 7 is a schematic representation of the matrix display of the auxiliary game of FIG. 6, steps further in the game.

After a number of winning games without a sum of 21 (non-event holds), a new player's card sum of 21 occurs. The symbols 160, 161 and 162 are moved in the gaming matrix display 110 and new winning symbols 160 fill the column 141. Three winning symbols 160 are now on the second line 152 of the gaming matrix display 110. The information display outputs 116 and 121 show that the electronic gaming apparatus 101 pays a new prize of 5$. The winning symbols 160 of the second line 152 are replaced by payment symbols 162, yielding a gaming matrix display 110 as shown in FIG. 7.

Figure 8:
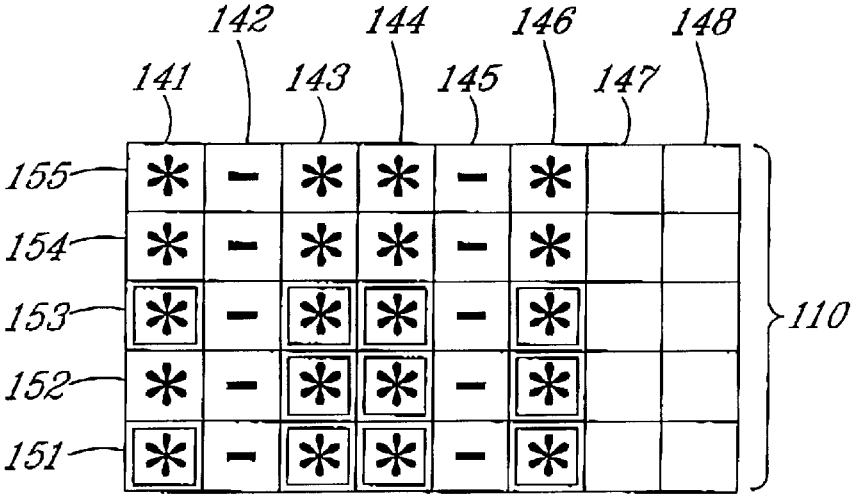
FIG. 8 is a schematic representation of the matrix display of the auxiliary game of FIG. 7, steps further in the game.
Figure 5:
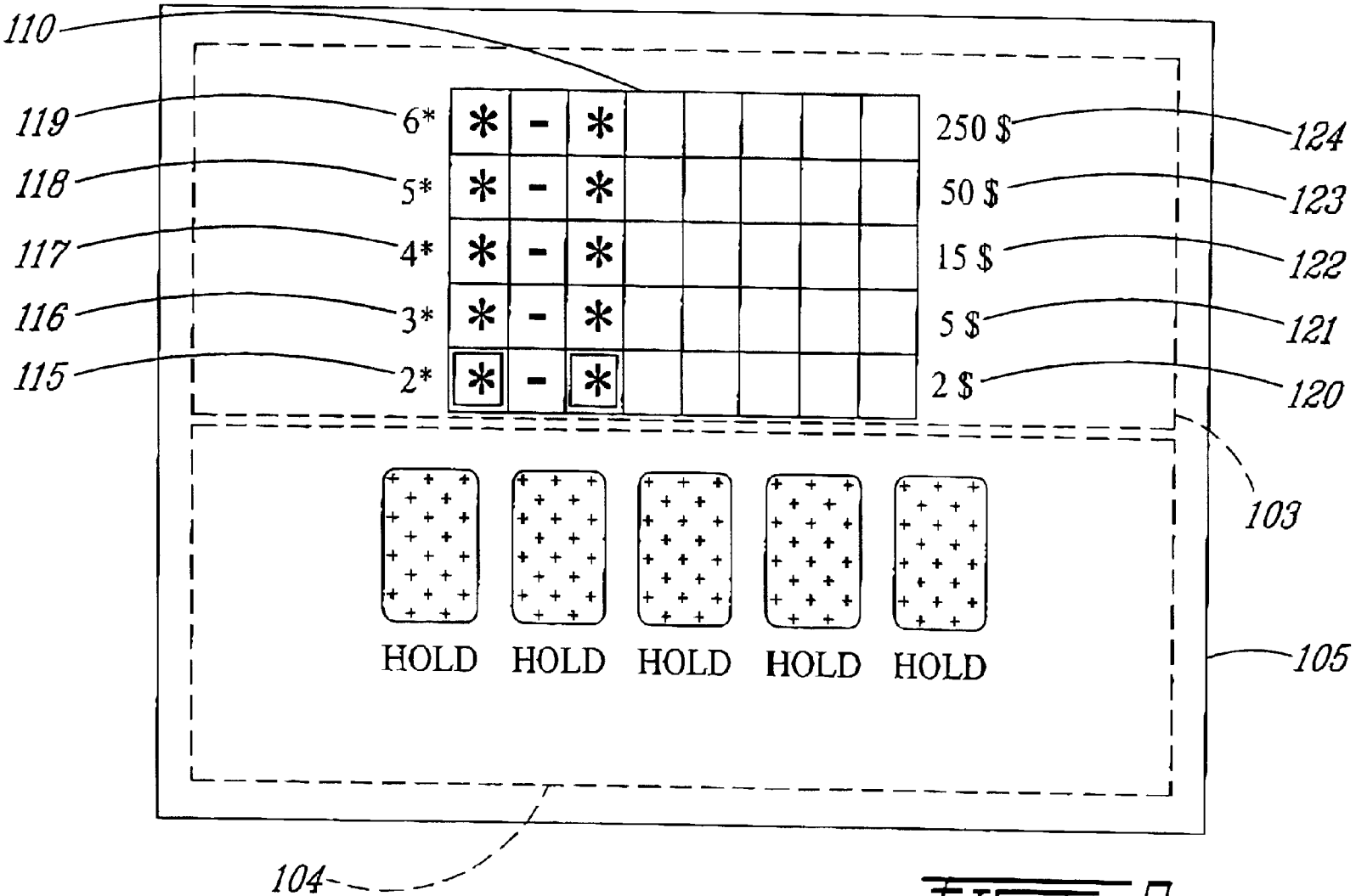

The player then loses a game and wins another one with a card sum of 21. Two new columns of symbols are inserted in the gaming matrix display 110. The gaming matrix now displays two winning symbols 160 on the first line 151 and four on the third line 153. The electronic gaming apparatus pays a prize of 17$ (2$+15$) according to the information display outputs 115, 120, 117 and 122. The winning symbols 160 of the first and third lines 151 and 153 are replaced by payment symbols 162, yielding a gaming matrix display 110 as shown in FIG. 8. The auxiliary game 103 continues until someone activates the auxiliary button 107. When the gaming matrix display 110 is full, the oldest column 148 is erased and a new column of symbols corresponding to the event is introduced in column 141 of the gaming matrix display 110. Prizes are awarded when the required number of winning symbols 160 is obtained, regardless of the position of the symbols on the line.

To obtain a number of winning symbols 160, players can play numerous games in the primary game 102 without influencing the auxiliary game 103 as long as the outcomes of those games produce non-event holds. Players can therefore play on the primary game 102 without decreasing their chances of winning auxiliary prizes as long as they do not gather no-credit events. It will be readily understood that emptying the gaming matrix display 110 prior to using the auxiliary game 103 can consist in assigning no-credit events to all previous events.

A different embodiment includes the use of this auxiliary game within an electronic Poker game, as shown in FIG. 9. In this embodiment, the class of outcomes producing credit events could be defined following the rules of Poker to be a hand corresponding to <<(three of a kind))>> or better. The class of non-event hold could be a pair and any other hand could be no-credit event. The prizes and the criteria to win the prizes in the auxiliary game should be modified according to the difficulty to achieve the criteria. This embodiment will be more readily understood with reference to the following example.

EXAMPLE 2

A new hypothetical game would be played as follows. A player begins with an empty auxiliary game matrix display 110. Let us assume that a series of outcomes in the Poker game 104 occurred as shown in Table 1. Also shown is the result of the outcomes in the Poker game and the corresponding events in the auxiliary game 103:

TABLE 1

Hypothetical Poker game with auxiliary game.

| Outcomes | Primary Game | Auxiliary Game |
|---|---|---|
| 1) pair of Jack | win | non-event hold |
| 2) 3 of a kind | win | credit event |
| 3) loss | loss | no-credit event |
| 4) pair of 3 | loss | non-event hold |
| 5) flush | win | credit event |
| 6) pair of 7 | loss | non-event hold |
| 7) pair of aces | win | non-event hold |

Figure 6:
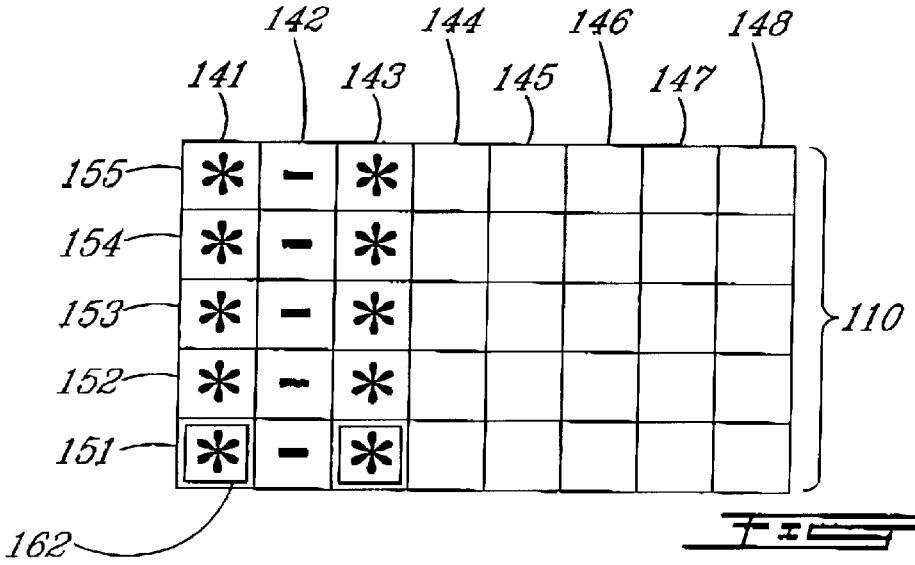
FIG. 6 is a schematic representation of the matrix display of the auxiliary game of FIG. 5, steps further in the game.

The result of this series of outcomes in the gaming matrix display 110 is the same as the one shown in FIG. 6. As can be seen from Table 1, the outcomes are three losses and four wins, but the results shown in the gaming matrix display 110 demonstrate that the player might prefer to change its Poker game strategy in order to win or get non-event holds in the auxiliary game. The classes of outcomes defined above give new criteria to play Poker such as getting a credit event in the auxiliary game 103 even with a loss in the primary game 104. Depending on the probabilities of winning a prize in the auxiliary game 103 with the above defined classes of events, the prizes and criteria to win prizes in the auxiliary game 103 could differ from the ones used when the primary game is Blackjack.

Some variants could be implemented in the auxiliary game when Poker is the primary game because of the number of different outcomes and the different probabilities associated with each of these outcomes. For example, a straight flush or better could erase a no-credit event and add a new credit event in the auxiliary game. Another example of a variant could be that two credit events are only paid when they are entered sequentially in the auxiliary game.

Figure 10:
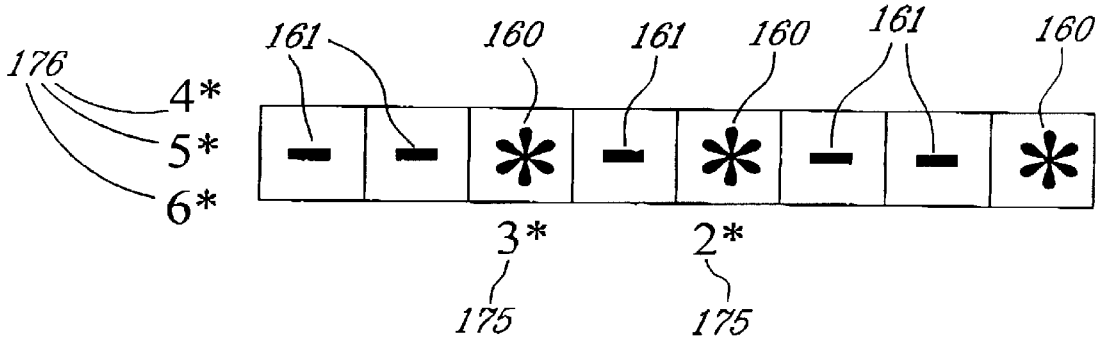
FIG. 10 is a schematic representation of an alternative to the display shown in FIG. 3.

Different displays can be used in accordance with the invention. In the gaming matrix display 110, the columns and rows could be interchanged to yield a different embodiment of the display 110. The number of columns 141 through 148 and rows 155 through 151 can be modified to allow for different types of prize payouts. The information display outputs 115 through 124 would be modified accordingly. FIG. 10 illustrates a different display wherein the winning symbols 160 and losing symbols 161 are displayed on a single line and payment symbols 162 are not needed. The prizes paid 175 move along the symbols 160 and 161 in the auxiliary game display when new prizes are paid according to winning symbols 160. The prizes paid 175 move along with the last winning symbol 160 paid for this prize. The unpaid prizes 176 in the last eight entries of the display stay beside the line of symbols 160 and 161. The number of entries can vary for effect and motivation.

Figure 11:
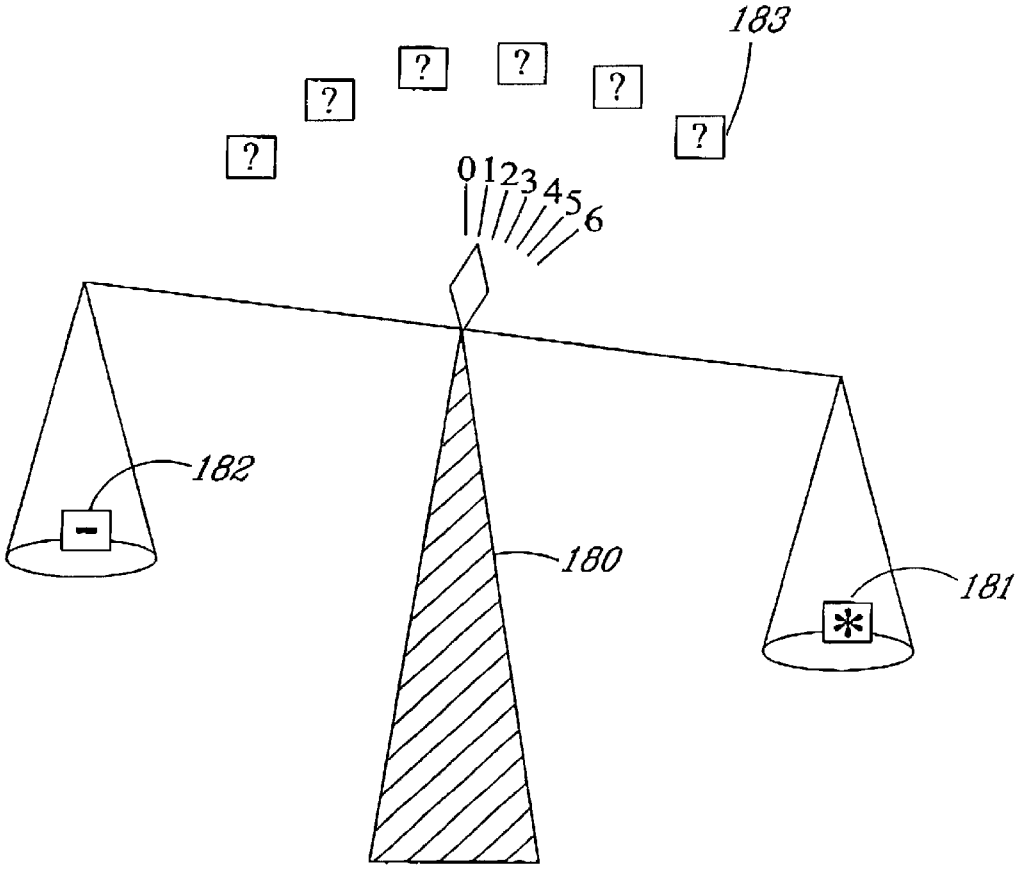
FIG. 11 is a schematic representation of an alternative to the display shown in FIG. 3.

FIG. 11 shows a totally different display wherein the credit events are monitored as blocks 181 and 182 on a scale 180. In this embodiment, no-credit blocks 182 are weight free and credit event blocks 181 have a standard weight. A block from a bank of available blocks 183 is placed on the scale each time a new event occurs in the primary game 102. A limited number of blocks 181,182 and 183 can be used with the scale 180. As can be imagined, with this embodiment of displaying information in the auxiliary game 103, the number of events monitored is fixed (in this case, the height of the scale is used to control the total number of events) and a prize can be won when all the blocks are attributed and displayed (blocks 181,182 and all of the blocks 183 are distributed on the scale 180). After that, the scale 180 is emptied, the bank of available blocks 183 is renewed and a new game can begin in the auxiliary game 103. The advantage of this game is that it motivates the player to empty the bank of available blocks 183 by placing them all on the scale 180. The player can win a prize corresponding to the accumulation of credit events regardless of the order.

Figure 12:
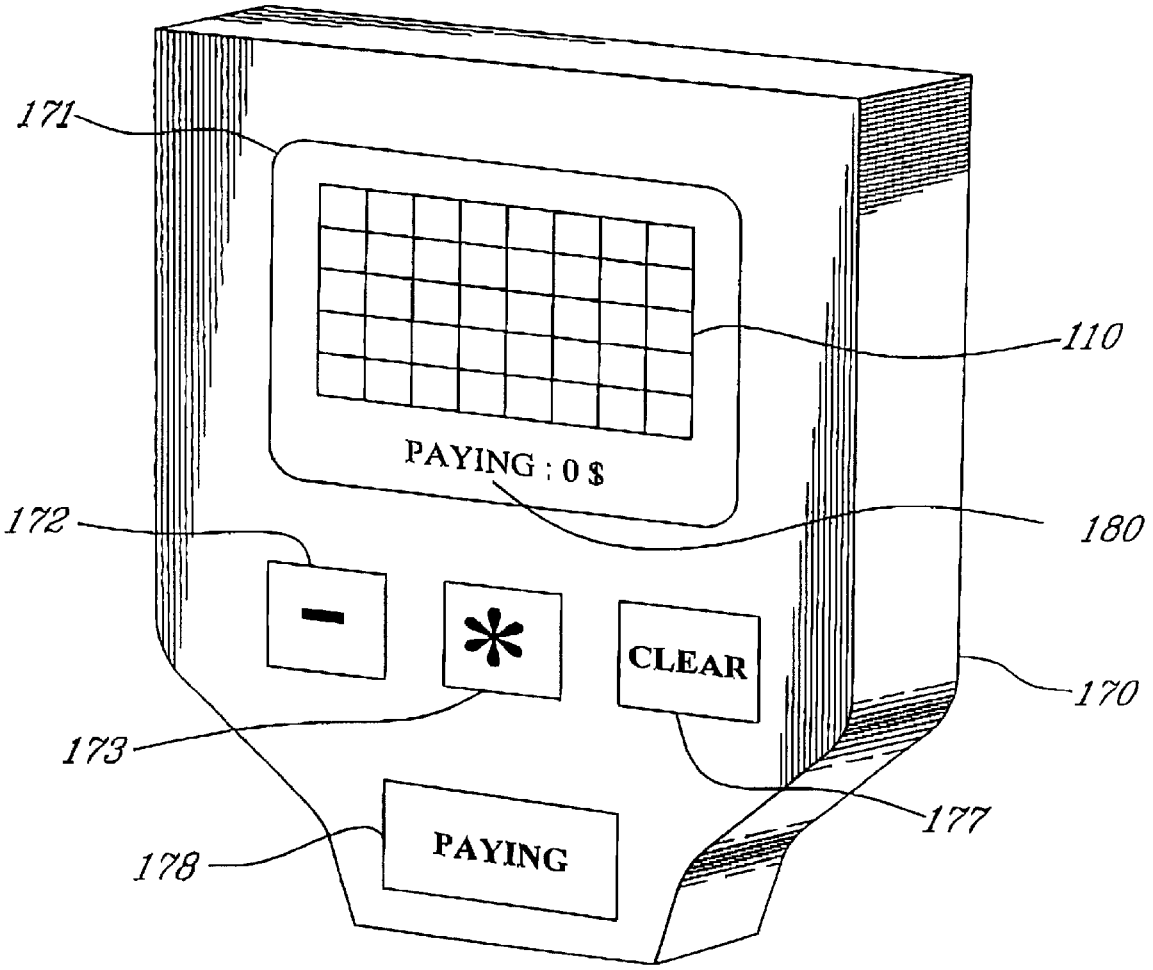
FIG. 12 is a front elevational view of a schematic representation of a table auxiliary electronic apparatus built in accordance with the present invention.

In a different embodiment of the invention, the auxiliary game is used in live games like Blackjack on casino tables. The same rules are used to determine classes of events. In this embodiment, the use of an electronic gaming apparatus 170, such as the one shown in FIG. 12, is preferred. One embodiment of this electronic gaming apparatus 170 includes an auxiliary playing screen 171 with a gaming matrix display 110 and information outputs 180. Also, four buttons are added: a losing hand button 172 filling columns with losing symbols 161, a winning hand button 173 filling columns with winning symbols 160, a clear button 177 emptying the whole gaming matrix display 110 and a paying button 178 activating the calculation of prizes, displaying them on the auxiliary playing screen 171 as payed outputs 180 and activating the replacement of the corresponding winning symbols 160 by payment symbols 162.

To obtain a gaming matrix display 110 corresponding to that seen on FIG. 6, the live Blackjack game must be played as described in example 1. To reproduce the events of the example, a dealer using the electronic gaming apparatus 170 would activate, in order, the clear button 177, the winning hand button 173 one time, the losing hand button 172 one time, the winning hand button 173 another time and then the paying button 178 and would then obtain a similar display.

Figure 13:
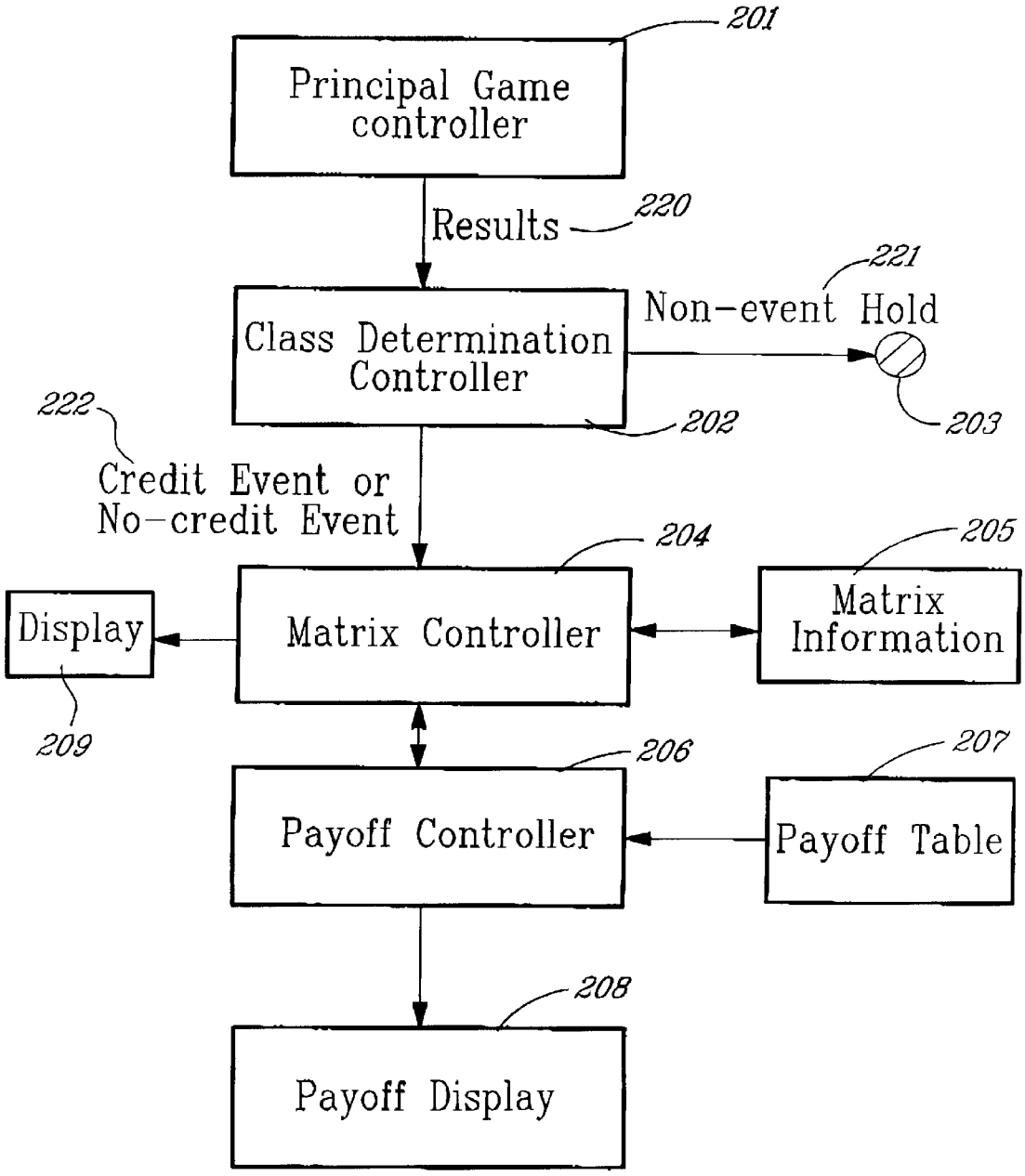
FIG. 13 is a block diagram of a preferred embodiment.

FIG. 13 shows a block diagram of the first preferred embodiment, i.e. the electronic Blackjack game. It shows the principal game controller 201 which transmits the results 220 of the principal game to a class determination controller 202. If the result is determined to be a non-event hold 221, the information is held constant 203. If it is not a non-event hold (credit event or no-credit event 222), a matrix controller 204 updates the matrix information 205 and sends the updated information to a payoff controller 206. The payoff controller 206 evaluates the situation using a payoff table 207. If a prize is won, it informs the player, with the payoff display 208, of what prize is won. Then, the matrix controller 204 receives updated information about the winning or non-winning status and updates the display 209 of the auxiliary game according to this information.

Figure 14:
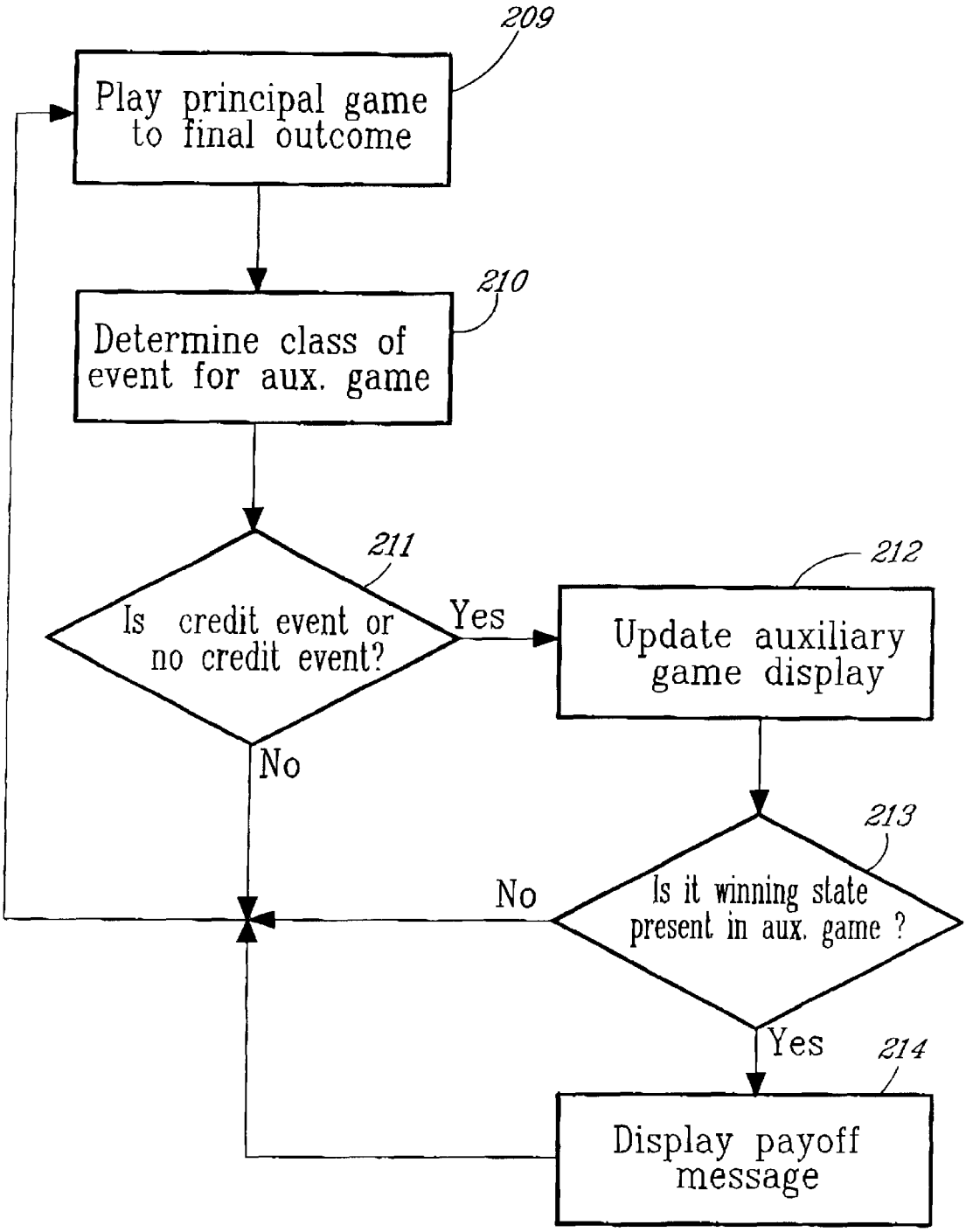
FIG. 14 is a flow chart of the steps of playing the auxiliary game according to a preferred embodiment.

FIG. 14 shows a flow chart of the sequence of events when playing the auxiliary game with the preferred embodiment. A player plays the primary game to a final outcome 209. Then, the apparatus determines the class of event for the auxiliary game 210. If the class of event is a credit or a no-credit event 211, the auxiliary game display is updated 212. Then the auxiliary game evaluates 213 if the new event produces a winning status for the player and, if it is the case, a payoff message is displayed 214. Then, a new principal game can be played 209.

Different criteria could be used to attribute prizes in accordance with the invention using or without relying on the display. One of them could be to have bonus prizes awarded when a predetermined number of credit event symbols are monitored consecutively by the auxiliary game. Another one could be to award a player that has accumulated two winning event symbols only if these symbols are entered consecutively in the auxiliary game without any no-credit event between them. Another one could be to first fill up all of the spaces of the display and then award the player for the number of credit events gathered. Different prizes are awarded for different numbers of credit events. After rewarding the player, the auxiliary game is automatically emptied.

As stated above, there are no constraints on the definition of the criteria for winning prizes. The criteria are examples and preferred embodiments. Someone skilled in the art of gaming and of building gaming apparatus could find other criteria pleasing players. These criteria could be a particular sequence of credit events, particular outcomes generating special outputs, fixed number or never ending sequences of events monitored, single prizes or series of increasing amounts associated with criteria of different levels of difficulty, etc. The different types of prize awarding techniques do not change the method of playing an auxiliary game with prize rewarding system of the present invention.

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features herein before set forth, and follows in the scope of the appended claims.

What is claimed is:

1. A method of awarding a prize in an auxiliary game played along with a principal game, the method comprising the steps of:

establishing a first class of outcomes in said principal game associated with a no-credit event in said auxiliary game;

establishing a second class of outcomes in said principal game associated with a credit event in said auxiliary game;

monitoring credit events in said auxiliary game over a predetermined number of events in said auxiliary game; and awarding a prize in said auxiliary game when a predetermined number of credits are present in said predetermined number of events in said auxiliary game, said predetermined number of events being at least five, said number of credits being less than said number of events and said prize being awarded when said credits occur non-consecutively within said number of events.

2. The method as defined in claim 1, further comprising establishing a third class of outcomes in the said principal game associated with a non-event hold in said auxiliary game; whereby avoiding said no-credit events within a series of said credit events and said non-event holds increases the player's chances of winning a auxiliary game prize.

3. The method as defined in claim 2, wherein said step of awarding comprises evaluating said number of credits independently of an order or sequence thereof.

4. The method as defined in claim 2, wherein said step of awarding comprises awarding a first prize when a first number of credits are found in said predetermined number of events, and awarding at least one other prize of greater value when a predetermined number of credits higher than said first number of credits are found in said predetermined number of events.

5. The method as defined in claim 4, further comprising the steps of displaying information regarding said prizes awarded.

6. The method defined in claim 2, wherein:

said principal game is Blackjack or twenty-one;

said no-credit event is a loss in said primary game;

said credit event is a win with Blackjack or twenty-one; and said non-event hold is a win without reaching twenty-one.

7. The method as defined in claim 1, wherein said step of awarding comprises evaluating said number of credits independently of an order or sequence thereof.

8. The method as defined in claim 1, wherein said principal game is composed of a number of sub-games wherein:

said credit event is defined in at least one said sub-game;

said no-credit event is defined in at least one said sub-game; and said non-event hold is defined in at least one said sub-game.

9. The method as defined in claim 1, wherein said predetermined number of events is between seven and fourteen.

10. The method as defined in claim 1, wherein said step of awarding comprises awarding a first prize when a first number of credits are found in said predetermined number of events, and awarding at least one other prize of greater value when a predetermined number of credits higher than said first number of credits are found in said predetermined number of events.

11. The method as defined in claim 10, further comprising the steps of displaying information regarding credits obtained in said predetermined number of events, displaying when said first prize is won, and displaying when said at least one other prize is won.

12. The method as defined in claim 1, further comprising the step of displaying information regarding credits obtained in said predetermined number of events.

13. The method as defined in claim 12, wherein said step of displaying information is composed of:

displaying a matrix display; and filling up a row or column of said matrix display each time a new said event occurs in said principal game with symbols corresponding to said credit event or said no-credit event.

14. The method as defined in claim 13, wherein said steps of filling up said matrix is composed of:

erasing said symbols corresponding to oldest said event; and displaying new said symbols in said matrix display when adding said symbols corresponding to a new said event results of exceeding said predetermined number of events in said auxiliary game.

15. The method as defined in claim 13, further comprising the steps of changing said symbols corresponding to said events that contribute to award a said prize.

16. The method as defined in claim 1, wherein said predetermined number of events comprises a predetermined number of consecutive previous events, said auxiliary game being started with said previous events as no-credit events.

17. The method defined in claim 1, further applied in an electronic gaming apparatus.

18. A method of awarding a prize in an auxiliary game played along with a principal game, the method comprising the steps of:

establishing a first class of outcomes in said principal game associated with a no-credit event in said auxiliary game;

establishing a second class of outcomes in said principal game associated with a credit event in said auxiliary game;

establishing a third class of outcomes in said principal game associated with a non-event hold in said auxiliary game; whereby avoiding said no-credit events within a series of said credit events and said non-event holds increases the player's chances of winning a auxiliary game prize;

monitoring credit events and no-credit events in said auxiliary game over a predetermined number of events in said auxiliary game; and awarding a prize in said auxiliary game when a predetermined number of credits are present in said predetermined number of events in said auxiliary game.

19. The method as defined in claim 18, wherein said step of awarding comprises evaluating said number of events independently of an order or sequence thereof.

20. The method as defined in claim 18, wherein said step of awarding comprises awarding a first prize when a first number of credits are found in said predetermined number of events, and awarding at least one other prize of greater value when a predetermined number of credits higher than said first number are found in said predetermined number of events.

21. The method as defined in claim 20, further comprising the steps of displaying information regarding credits obtained in said predetermined number of events, displaying when said first prize is won, and displaying when said at least one other prize is won.

22. The method as defined in claim 21, further comprising the steps of displaying information regarding prizes awarded.

23. The method as defined in claim 20, wherein said steps of awarding comprises at least a number of 3 said prizes.

24. The method as defined in claim 18, further comprising the steps of displaying information regarding said credits obtained in said predetermined number of events.

25. The method as defined in claim 18, further comprising the steps of displaying information regarding said credits and said no-credits obtained in said predetermined number of events.

26. The method as defined in claim 25, wherein said steps of displaying information regarding credits and no-credits comprises showing a matrix display.

27. The method as defined in claim 26, wherein said matrix display is composed of a number of rows and a number of columns, wherein each said column is associated with a said event;

each said row is associated with a said prize and said predetermined number of events; and each said events are represented by symbols, one for said credit events and one for said no-credit events.

28. The method as defined in claim 27, further comprising steps of changing monitored said symbols contributing to awarding a said prize.

29. The method as defined in claim 21, wherein said steps of displaying information regarding credits and no-credits is done in order or sequentially thereof.

30. The method as defined in claim 29, wherein said of displaying information regarding credits and no-credits further comprise steps of replacing oldest said event by new said events when said predetermined number of events to be monitored in said auxiliary game are obtained.

31. The method as defined in claim 18, wherein said steps of monitoring credit events and no-credit events over a predetermined number of events comprises a number of consecutive previous events.

32. The method as defined in claim 18, wherein said principal game is composed of a number of different sub-games wherein:

said credit event is defined in at least one said sub-game;

said no-credit event is defined in at least one said sub-game; and said non-event hold is defined in at least one said sub-game.

33. The method as defined in claim 18, wherein said predetermined number of events to be monitored are at least 5.

34. The method as defined in claim 18, wherein said predetermined number of events to be monitored are is between 7 and 14.

35. The method as defined in claim 18, further applied in an electronic gaming apparatus.

36. The method as defined in claim 18, wherein:

said principal game is Blackjack;

said credit event is defined as a win with a card sum of 21;

said no credit event is defined as a loose; and said non-event hold is defined as a win without a card sum of 21.

37. The method defined in claim 18, wherein:

said principal game is a Poker game;

a win with a hand of cards corresponding to <<3 of a kind>> following the rules of Poker is defined as said credit event;

a said hand of cards corresponding to a <<pair>> following the rules of Poker is defined as said non-event hold; and a loss with a said hand of cards having no rank following the rules of Poker is defined as said no-credit event.

* * * * *